United States Patent [19]

Lee

[11] Patent Number: 5,027,994

[45] Date of Patent: Jul. 2, 1991

[54] STAPLER COMBINED WITH A CLIP DRIVER

[76] Inventor: Yong Woo Lee, 13-102 Woosung Apt., 188 Seocho-dong, Seocho-ku, Seoul, Rep. of Korea

[21] Appl. No.: 514,249

[22] Filed: Apr. 25, 1990

[30] Foreign Application Priority Data

Aug. 17, 1989 [KR] Rep. of Korea ..... 12074[U]
Nov. 10, 1989 [KR] Rep. of Korea ..... 16591[U]

[51] Int. Cl.[5] ..... B25C 5/02

[52] U.S. Cl. ..... 227/120; 7/170; 81/488

[58] Field of Search ..... 7/160, 170; 29/243.56, 29/278; 81/488; 227/120, 156

[56] References Cited

U.S. PATENT DOCUMENTS 4,040,556 8/1977 Dahle ..... 727/170
4,491,261 1/1985 Mitsuhashi ..... 7/160 X
4,727,610 3/1988 Lin ..... 7/160

FOREIGN PATENT DOCUMENTS 3139995 4/1983 Fed. Rep. of Germany ..... 227/120
39-21907 8/1964 Japan .
55-159157 11/1980 Japan .

*Primary Examiner*—Timothy V. Eley
*Attorney, Agent, or Firm*—Fleit, Jacobson, Cohn, Price, Holman & Stern

[57] ABSTRACT

A stapler comprising a drive member and a staple magazine member. The stapler also comprises a clip driver including upper and lower casings and a connecting band. The connecting band has a staple guide grooves so as to function as an anvil. The clip driver is pivotally connected to the stapler by means of pivot member.

5 Claims, 3 Drawing Sheets

STAPLER COMBINED WITH A CLIP DRIVER

BACKGROUND OF THE INVENTION

The present invention relates to a stapler combined with a clip driver so as to be selectively used for either purpose, as desired.

Conventionally, a stapler and a clip driver have been manufactured separately and provided as different articles, thus making the handling and keeping thereof troublesome.

SUMMARY OF THE INVENTION

Therefore, the object of the present invention is to overcome the above-mentioned disadvantage encountered in the prior art and to provide a stapler combined with a clip driver.

In accordance with the present invention, this object can be accomplished by providing a stapler comprising a drive member and a staple magazine member having axial holes formed on the rear end thereof, said stapler characterized by further comprising: a clip driver including upper and lower casings and a connecting band firmly connecting said casings and having a staple guide grooves so as to function as an anvil for said stapler; and pivot means for pivotally connecting said clip driver to the stapler.

In accordance with one aspect of the present invention, the pivot means comprises a pair of pivot portions formed on the rear end of the drive member of the stapler and each provided with an axial hole aligning with the axial holes formed on the staple magazine member, a pair of pivot portions formed on the rear end of the clip driver and each provided with an axial hole aligning said axial holes of the stapler, and a pivot pin inserted into aligned axial holes of the stapler and clip driver to pivotally connect the clip driver to the stapler.

In accordance with the other aspect of the present invention, the pivot means comprises a pair of grooves inwardly formed on the rear end of the drive member of the stapler and aligned with the axial holes of the staple magazine member, a pivot portion formed on the rear end of the clip driver and provided with an extended axial hole aligning said axial holes of the stapler, and a pivot pin inserted into aligned axial holes of the stapler and clip driver and engaged, at both ends thereof, in said grooves of the stapler, respectively, to pivotally connect the clip driver to the stapler.

The above and other objects, features and advantages of the invention will become apparent from the following description of the preferred embodiments taken in conjunction with the accompanying drawings.

DESCRIPTION OF THE PREFERRED EMBODIMENTS

Figure 1:
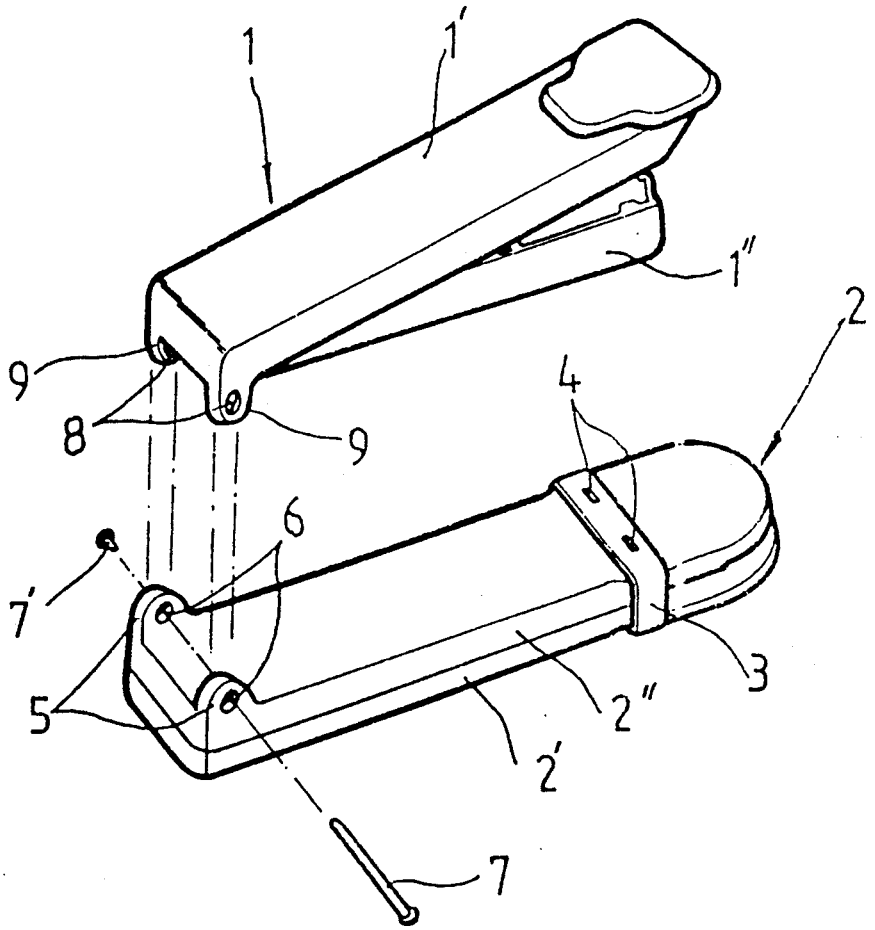
FIG. 1 is an exploded perspective view of the stapler combined with a clip driver in accordance with an embodiment of the present invention.

Referring to FIG. 1, there is shown a stapler 1 combined with a clip driver 2 in accordance with an embodiment of the present invention. The stapler 1 is a well-known type which comprises a drive member 1' and a staple magazine member 1''. The clip driver 2 has upper and lower casings 2' and 2'' and a connecting band 3 adapted to firmly connect said casings 2' and 2''.

In accordance with the present invention, the stapler 1 does not include a base member which is an essential element in conventional staplers. The clip driver 2 functions as the base member of the stapler 1. To this end, the clip driver 2 has staple guide grooves 4 formed on the bottom surface of the connecting band 3 and adapted to function as an anvil.

The clip driver 2 is pivotally attached at its rear end to the rear end of the stapler 1, by means of pivot means. The pivot means comprises a pivot pin 7. The clip driver 2 has a pair of pivot portions 5 downwardly (i.e., upwardly when viewed in FIG. 1) formed on the rear end of the lower casing 2''. Each pivot portion 5 is provided with an axial hole 6 for receiving the pivot pin 7 therein. The drive member 1' of the stapler 1 has a pair of pivot portions 9 downwardly formed on the rear end thereof. Each of pivot portions 9 is provided with an axial hole 8 for receiving the pivot pin 7 therein. In addition, the staple magazine member 1'' of the stapler 1 has a pair of axial holes (not shown) for receiving the pivot pin 7. In assembling the stapler 1 and the clip driver 2, all axial holes of the stapler 1 and the clip driver 2 are aligned with one another. Then, the pivot pin 7 is inserted into the aligned axial holes and a screw 7' is connected to the leading end of the pivot pin 7, in order to avoid separation of the pivot pin 7 from axial holes. Thus, the stapler 1 and the clip driver 2 are pivotally secured to each other at their rear ends by means of the pivot pin 7.

Figure 2:
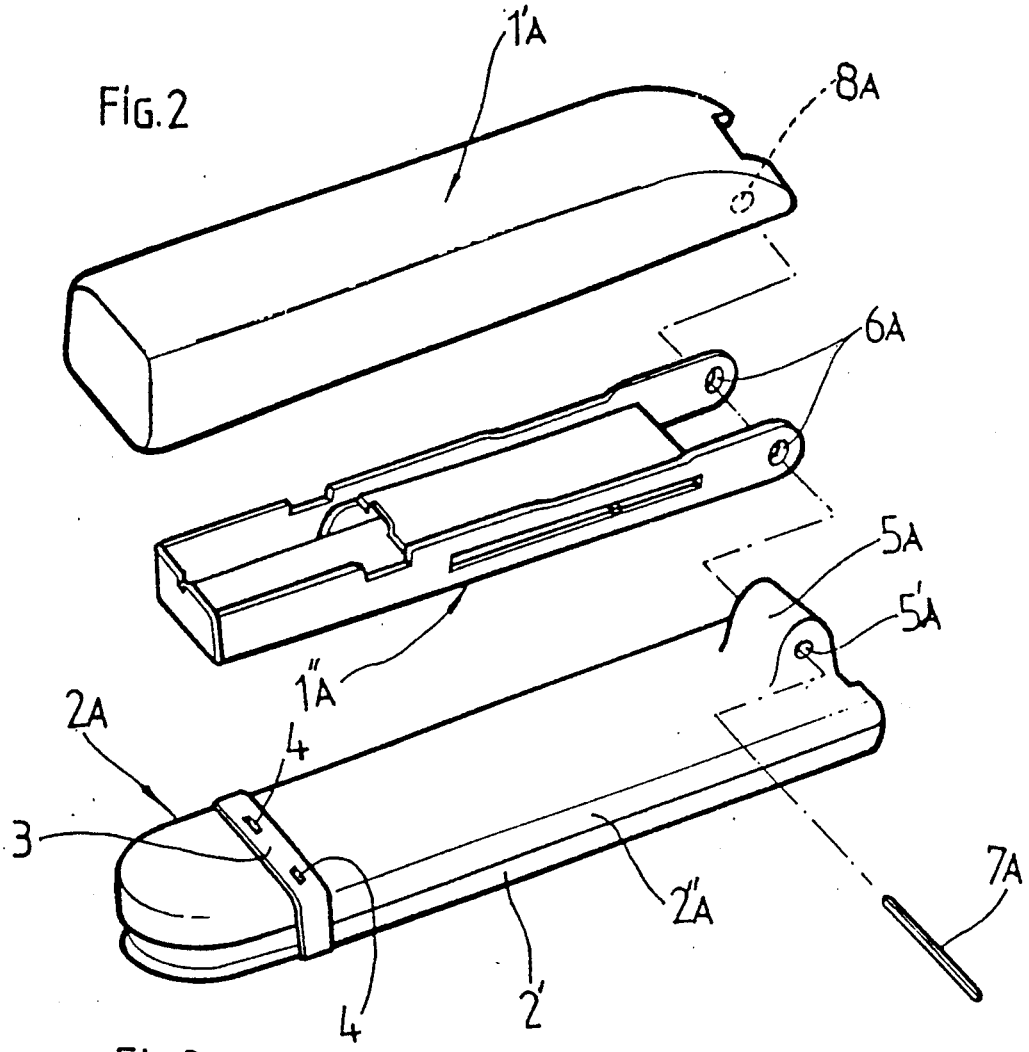
FIG. 2 is an exploded perspective view of the stapler combined with a clip driver in accordance with the second embodiment of the present invention.
Figure 4:
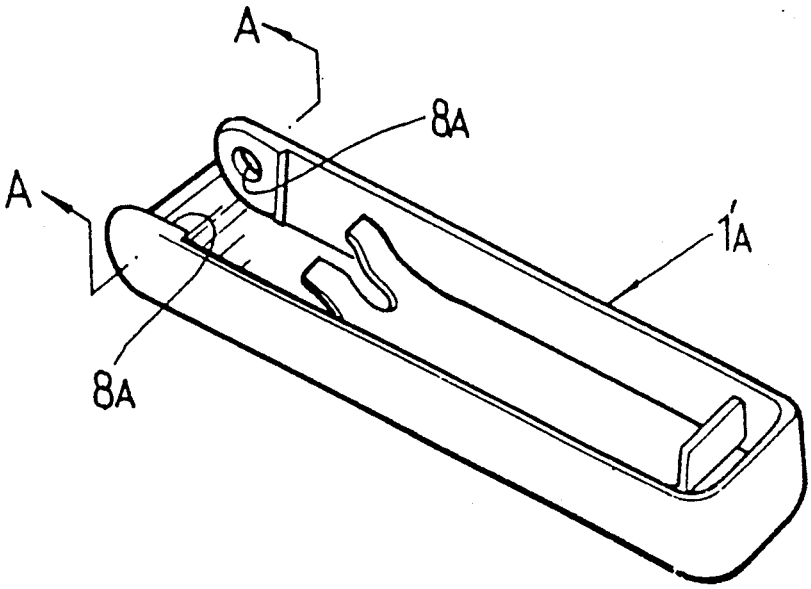
FIG. 4 is a perspective view of the drive member of the stapler shown in FIG. 2.
Figure 5:
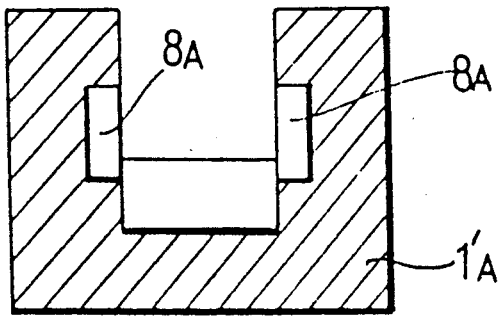
FIG. 5 is a cross-sectional view taken along the line A—A in FIG. 4.

Referring to FIG. 2, there is shown another embodiment of the present invention to a stapler 1A having a construction dissimilar to that of FIG. 1. In this embodiment of the present invention, the pivot means for pivotally connecting the clip driver to the stapler is slightly different from that of the embodiment shown in FIG. 1. That is, the clip driver 2A has a pivot portion 5A downwardly (i.e., upwardly when viewed in FIG. 2) formed on the rear end of the lower casing 2''A. The pivot portion 5A is provided with an extended axial hole 5'A for receiving a pivot pin 7A. The staple magazine member 1''A of the stapler 1A has a pair of axial holes 6A for receiving the pivot pin 7A. In addition, the drive member 1'A of the stapler 1A has a pair of grooves 8A inwardly formed on the rear end thereof, as shown in FIGS. 4 and 5. The grooves 8A receive both ends of the pivot pin 7A, respectively. In assembling the stapler 1A and the clip driver 2A, all axial holes are aligned with one another. Then, the pivot pin 7A is inserted into the aligned axial holes. Finally, both ends of the pivot pin 7A are engaged in grooves 8A of the drive member 1'A of the stapler 1A. Thus, the stapler 1A and the clip driver 2A are pivotally secured to each other at their rear ends by means of the pivot pin 7A.

Figure 3:
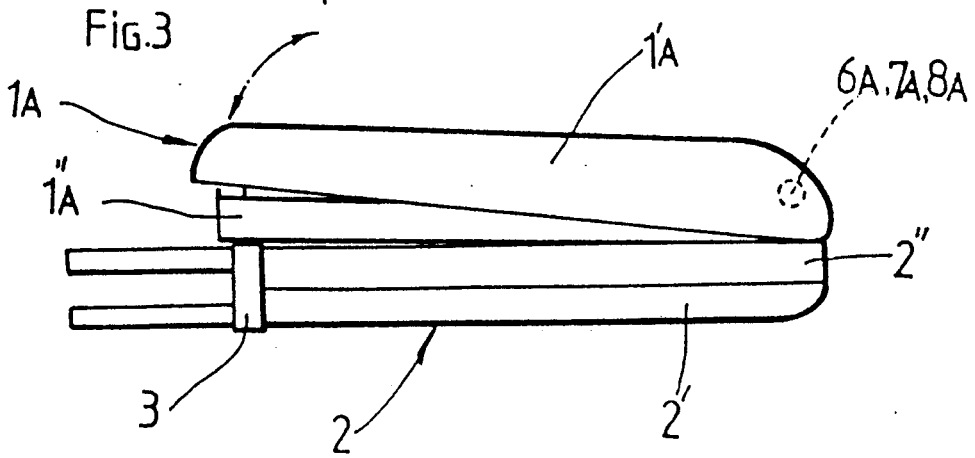
FIG. 3 is a side view showing the using condition of the stapler shown in FIG. 2.

The above-mentioned stapler combined with the clip driver can be used in a conventional manner, under the condition shown in FIG. 3. In binding stacked sheets of paper, the drive member 1' or 1'A of the stapler 1 or 1A is pivoted upwardly with respect to the staple magazine member 1" or 1"A, in order to load a series of staples on said staple magazine member. Then, the drive member 1' or 1'A of the stapler 1 or 1A is pivoted to its operation position in which the drive member is mounted on the staple magazine member. Then, the sheets of paper are placed in the space between the stapler 1 or 1A and the clip driver 2 or 2A. When pressing the front end of the stapler 1 or 1A under this condition, the staple is driven through the clearance by a staple drive plate attached to the drive member 1' or 1'A of the stapler 1 or 1A to penetrate the sheets of paper. The staple is then deformed as it is pressed against grooves 4 formed on the connecting band 3 of the clip driver 2 or 2A thereby to bind the sheets of paper.

When desired to temporally bind the sheets of paper, the clip driver 2 or 2A attached to the stapler 1 or 1A can be used in a conventional manner.

As apparant from the above description, the present invention provides a stapler combined with a clip driver, thereby enabling the handling and keeping thereof to be convenient.

What is claimed is:

1. A stapler comprising a drive member and a staple magazine member having axial holes formed on the rear end thereof, said stapler characterized by further comprising:

a clip driver including upper and lower casings and a connecting band firmly connecting said casings and having staple guide grooves so as to function as an anvil for said stapler; and a pivot means for pivotally connecting said clip driver to the stapler.

2. The stapler in accordance with claim 1, wherein said pivot means comprises a pair of pivot portions formed on a rear end of the drive member of the stapler and each provided with an axial hole aligning with the axial holes formed on the staple magazine member, a pair of pivot portions formed on a rear end of the clip driver and each provided with an axial hole aligning said axial holes of the stapler, and a pivot pin inserted into aligned axial holes of the stapler and clip driver to pivotally connect the clip driver to the stapler.

3. The stapler in accordance with claim 1, wherein said pivot means comprises a pair of grooves inwardly formed on the rear end of the drive member of the stapler and aligned with the axial holes of the staple magazine member, a pivot portion formed on the rear end of the clip driver and provided with an extended axial hole aligned said axial holes of the stapler, and a pivot pin inserted into aligned axial holes of the stapler and clip driver and engaged, at both ends thereof, in said grooves of the stapler, respectively, to pivotally connect the clip driver to the stapler.

4. In a combination of a stapler and a clip driver, said stapler including a drive member and a staple magazine member having axial holes formed on the rear end thereof, respectively, said clip driver including upper and lower casings and a connecting band firmly connecting said casings and having staple guide grooves so as to function as an anvil for aid stapler and pivot means for pivotally connecting said clip driver to the stapler, said pivot means including a pair of pivot portions formed on the rear end of the drive member of said stapler and each provided with an axial hole aligning with the axial holes formed on the staple magazine member, a pair of pivot portions formed on the rear end of said clip driver and each provided with an axial hole aligning with said holes of said stapler, and a pivot pin inserted into aligned axial holes of the stapler and the clip driver to pivotally connect said clip driver to the stapler.

5. In a combination of a stapler and a clip driver, said stapler including a drive member and a staple magazine member having axial holes formed on the rear end thereof, respectively, said clip driver including upper and lower casings and a connecting band firmly connecting said casings and having staple guide grooves so as to function as an anvil for said stapler and pivot means for pivotally connecting said clip driver to the stapler, said pivot means including a pair of grooves inwardly formed on the rear end of the drive member of the stapler and aligned with the axial holes of the stapler magazine member, a pivot portion formed on the rear end of said clip driver and provided with an extended axial hole aligned with said axial holes of the drive member and the stapler magazine member, and a pivot pin inserted into aligned axial holes of the stapler magazine member and clip driver and engaged, at both ends thereof, in said grooves of the drive member, respectively, to pivotally connect said clip driver to said stapler.

* * * * *